US007131385B1

(12) United States Patent
Ehlers et al.

(10) Patent No.: US 7,131,385 B1
(45) Date of Patent: Nov. 7, 2006

(54) METHOD FOR BRAKING A VESSEL WITH TWO MARINE PROPULSION DEVICES

(75) Inventors: Jeffery C. Ehlers, Neenah, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/251,273

(22) Filed: Oct. 14, 2005

(51) Int. Cl.
*B63H 25/44* (2006.01)

(52) U.S. Cl. ..... 114/145 R; 440/79

(58) Field of Classification Search ..... 114/144 R, 114/144 B, 145 R, 145 A; 440/79, 80
See application file for complete search history.

(56) References Cited

U.S. PATENT DOCUMENTS

| | | | | |
|---|---|---|---|---|
| 3,512,494 | A * | 5/1970 | Gregoire | 114/337 |
| 5,735,718 | A | 4/1998 | Ekwall | 440/83 |
| 5,755,605 | A | 5/1998 | Asberg | 440/75 |
| 6,234,853 | B1 | 5/2001 | Lanyi et al. | 440/53 |
| 6,431,928 | B1 | 8/2002 | Aarnivuo | 440/58 |
| 6,623,320 | B1 | 9/2003 | Hedlund | 440/80 |
| 6,688,927 | B1 | 2/2004 | Aarnivuo | 440/58 |
| 6,705,907 | B1 | 3/2004 | Hedlund | 440/51 |
| 6,712,654 | B1 | 3/2004 | Putaansuu | 440/53 |
| 6,783,410 | B1 | 8/2004 | Florander et al. | 440/51 |

FOREIGN PATENT DOCUMENTS

| | | |
|---|---|---|
| WO | WO 03/042036 | 11/2002 |
| WO | WO 03/093102 | 4/2003 |
| WO | WO 03/093105 | 4/2003 |
| WO | WO 03/093106 | 4/2003 |

* cited by examiner

*Primary Examiner*—Ed Swinehart
(74) *Attorney, Agent, or Firm*—William D. Lanyi

(57) ABSTRACT

A method for controlling the movement of a marine vessel comprises steps that rotate two marine propulsion devices about their respective axes in order to increase the hydrodynamic resistance of the marine propulsion devices as they move through the water with the marine vessel. This increased resistance exerts a braking thrust on the marine vessel. Various techniques and procedures can be used to determine the absolute magnitudes of the angular magnitudes by which the marine propulsion devices are rotated.

30 Claims, 6 Drawing Sheets

METHOD FOR BRAKING A VESSEL WITH TWO MARINE PROPULSION DEVICES

BACKGROUND OF THE INVENTION

1. Field of the Invention

The present invention is generally related to a marine vessel having two marine propulsion devices and, more particularly, to a method for slowing the forward movement of the marine vessel by appropriately changing the physical positions of the marine propulsion devices relative to the hull of the marine vessel.

2. Description of the Related Art

Many different types of marine propulsion systems are known to those skilled in the art. These include outboard motors, sterndrive devices, and systems in which one or more marine drives extend downwardly through the hull of the marine vessel.

U.S. Pat. No. 5,735,718, which issued to Ekwall on Apr. 7, 1998, describes a drive unit for a boat having an engine with a flywheel surrounded by a flywheel casing, a propeller drive housing connected to, but electrically insulated from, the flywheel casing, and an input shaft for the propeller drive housing which is driven and electrically insulated from the flywheel.

U.S. Pat. No. 5,755,605, which issued to Äsberg on May 26, 1998, describes a propeller drive unit. The drive installation in a boat has two propeller drive units which extend out through individual openings in the bottom of a V-bottomed boat, so that the legs are inclined relative to each other. The leg of one drive unit can be set to turn the boat in one direction at the same time as the leg of the other drive unit can be set to turn the boat in the opposite direction, so that the horizontal counteracting forces acting on the legs cancel each other, while the vertical forces are added to each other to trim the running position of the boat in the water.

U.S. Pat. No. 6,234,853, which issued to Lanyi et al. on May 22, 2001, discloses a simplified docking method and apparatus for a multiple engine marine vessel. A docking system is provided which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system uses two marine propulsion units to respond to an operator's command signal and allows the operator to select forward or reverse commands in combination with clockwise or counterclockwise rotational commands either in combination with each other or alone.

U.S. Pat. No. 6,431,928, which issued to Aarnivuo on Aug. 13, 2002, describes an arrangement and method for turning a propulsion unit. A propeller drive arrangement for moving and steering a vessel traveling in the water is described. The propeller drive arrangement includes an azimuthing propulsion unit, a power supply, a control unit, and a sensor means. An operating means is provided for turning the azimuthing propulsion unit in relation to the hull of the vessel for steering the vessel in accordance with a steering command controlled by the vessel's steering control device. The operating means also includes a second electric motor for turning the azimuthing propulsion unit via a mechanical power transmission that is connected to the second electric motor.

U.S. Pat. No. 6,623,320, which issued to Hedlund on Sep. 23, 2003, describes a drive means in a boat. A boat propeller drive with an underwater housing which is connected in a fixed manner to a boat hull and has tractor propellers arranged on that side of the housing facing ahead is described. Arranged in that end portion of the underwater housing facing a stern is an exhaust discharge outlet for discharging exhaust gases from an internal combustion engine connected to the propeller drive.

U.S. Pat. No. 6,688,927, which issued to Aarnivuo on Feb. 10, 2004, describes an arrangement and method for turning a propulsion unit. The arrangement comprises an azimuthing propulsion unit and operating equipment for turning the azimuthing propulsion unit to steer the vessel. The operating equipment comprises an electric motor for rotating the propulsion unit by means of a mechanical power transmission machinery connected to the electric motor. A power unit supplies electric power to the electric motor. A control unit controls the operation of the electric motor by controlling the power unit.

U.S. Pat. No. 6,712,654, which issued to Putaansuu on Mar. 30, 2004, describes the turning of a propulsion unit. It is a method and apparatus for moving and steering a vessel traveling in water. The arrangement for moving and steering a vessel includes a propulsion unit having a chamber positioned outside the vessel equipment for rotating a propeller arranged in connection with the chamber, and a shaft means connected to the chamber for supporting the chamber in a rotatable manner at the hull of the vessel. At least one hydraulic motor is used for turning the shaft means in relation to the hull of the vessel for steering the vessel. The arrangement also includes a means for altering the rotational displacement of the hydraulic engine.

U.S. Pat. No. 6,705,907, which issued to Hedlund on Mar. 16, 2004, describes a drive means in a boat. A boat propeller drive with an underwater housing which is connected in a fixed manner to a boat hull and has tractor propellers arranged on that side of the housing facing ahead is described. In the rear edge of the underwater housing, a rudder blade is mounted for pivoting about a vertical rudder axis.

U.S. Pat. No. 6,783,410, which issued to Florander et al. on Aug. 31, 2004, describes a drive means in a boat. A boat propeller drive unit with an underwater housing is described. The housing is solidly joined to a boat hull and has pulling propellers on the forward facing side of the housing. At the aft edge of the underwater housing, a rudder is mounted, comprising a first rudder blade mounted in the underwater housing and a second rudder blade mounted on the aft edge of the first rudder blade.

International Patent Application WO 03/042036, which was filed by Arvidsson, describes a remote control system for a vehicle. The system comprises a primary heading sensor fixedly attached to the vehicle which is adapted to detect a reference heading. It also comprises a remote control unit which comprises a steering input manipulator. The remote control unit is either portable by a user or rotationally attached to the vehicle relative to a main axis of the vehicle. It is adapted to communicate steering input data to a steering computer which is programmed to process the steering input data into steering commands and to communicate the steering commands to a steering mechanism of the vehicle.

International Patent Application WO 03/093105, which was filed by Mansson, describes a boat hull with an outboard drive and outboard drive for boats. The boat hull has an outboard drive unit which comprises an underwater housing mounted on the outside of the hull bottom and a gear housing mounted on the inside of the hull bottom and joined to the underwater housing. Between the underwater housing and the gear housing there is fixed a mounting plate, which, together with a screw down plate, with elastic ring inserts, fixes the drive unit to a flange, which is made on the inside of a well surrounding an opening in the hull bottom.

International Patent Application WO 03/093106, which was filed by Arvidsson et al., describes an outboard drive for boats. It comprises an underwater housing, in which two propeller shafts are mounted and are driven via a first bevel gearing enclosed in the underwater housing, and a second bevel gearing enclosed in a gear housing. With the aid of a mounting element joined to the underwater housing and the gear housing, the drive unit can be mounted in an opening in the bottom of a boat hull, with the underwater housing on the outside and the gear housing on the inside of the hull. The mounting element forms a housing which defines, firstly, an oil reservoir for the oil of the drive unit and, secondly, a surrounding chamber through which engine cooling water flows and which is used for cooling the oil in the reservoir.

International Patent Application WO 02/093102, which was filed by Arvidsson et al., describes a method of steering a boat with double outboard drives and a boat having double outboard drives. A method of steering a planing V-bottomed boat with double individual steerable outboard drive units with underwater housings is described. The underwater housings extend down from the bottom of the boat. When running at planing speed straight ahead, the underwater housings are set with "toe-in". In other words, the underwater housings are inclined towards each other with opposite angles of equal magnitude relative to the boat centerline. When turning, the inner drive unit is set with a greater steering angle than the outer drive unit.

The patents described above are hereby expressly incorporated by reference in the description of the present invention.

When a marine vessel is operating at planing speeds and the operator of the vessel wishes to cause the vessel to stop, the operator typically moves a throttle handle from a forward velocity position to either neutral or reverse. In certain circumstances, where the operator of the marine vessel determines that a sudden stop is required, the manually controlled throttle handle can be moved rapidly from a forward velocity position to a reverse velocity position. This causes the propellers of the marine propulsion units to rapidly stop their rotation and then reverse their rotation to more rapidly slow the marine vessel and bring it to a stop. This circumstance would typically be employed in an emergency situation where the marine vessel operator determines that an immediate stop is necessary. When propellers are suddenly reversed, significant cavitation often occurs and the efficiency of the braking force caused by the reverse propellers is adversely affected. It would therefore be beneficial if a more effective braking technique could be provided to rapidly slow the forward advance of a marine vessel.

SUMMARY OF THE INVENTION

A method for controlling the movement of a marine vessel, in accordance with a preferred embodiment of the present invention, comprises the steps of providing first and second marine propulsion devices which are attached to the marine vessel on opposite sides of a longitudinal centerline that extends from the stern to the bow of the marine vessel. The marine propulsion devices extend downwardly into the water in which the marine vessel is operated. They are configured to support propulsors which, in turn, are configured to generate thrusts which are parallel to or coaxial with individual thrust directions for each of the two marine propulsion devices. They are supported by the marine vessel for rotation about generally vertical steering axes. The two marine propulsion devices are rotatable in both clockwise and counterclockwise directions about their respective vertical steering axes relative to a reference position in which the thrust direction is generally parallel to the longitudinal centerline of the marine vessel.

The method of the present invention in a particularly preferred embodiment also includes the step of receiving a signal to apply a braking force on the marine vessel. The signal is typically in the form of a command generated as a result of the marine vessel operator moving a manually controllable throttle handle. The method further comprises the step of causing the two marine propulsion devices to rotate in opposite directions about their respective steering axes by selected angular magnitudes in response to the command to exert a braking force.

The angular magnitudes by which the marine propulsion devices are rotated, in opposite rotational directions, are selected to create a hydrodynamic resistance to movement of the two marine propulsion devices through the water. The hydrodynamic resistance to movement of the marine propulsion devices through the water is intended to result in a braking force which is exerted on the marine vessel.

In a particularly preferred embodiment of the present invention, the causing step comprises the step of rotating a port side marine propulsion device in a clockwise direction, when viewed in a downward direction from the marine vessel along the steering axis, and the step of rotating the starboard marine propulsion device in a counterclockwise direction when similarly viewed in a downward direction from the marine vessel along the steering axis of the starboard marine propulsion device.

In a preferred embodiment of the present invention, the angular magnitudes by which the two marine propulsion devices are rotated are generally equal to each other in absolute magnitude, but in opposite rotational directions.

The method of the present invention can further comprise, in a preferred embodiment, the steps of determining a velocity characteristic of the marine vessel and selecting the angular magnitudes as a function of the velocity characteristic. This velocity characteristic can be the forward velocity of the marine vessel. Alternatively, the velocity characteristic can be a deceleration (i.e. the first derivative of velocity) or a deceleration rate (i.e. the second derivative of velocity) of the marine vessel. Those skilled in the art are aware that the second derivative of velocity is also referred to as "jerk".

In certain embodiments of the present invention, it can further comprise the step of determining a rate of movement of a throttle control device, such as a manually operated throttle handle, from an initial forward marine vessel velocity command to a current marine vessel velocity command. These velocity commands are represented by physical positions of the throttle handle before and after the operator moves the handle for the purpose of stopping the forward velocity of the marine vessel. The selecting step can comprise a plurality of selections of angular magnitudes which are sequentially selected as a function of changing magnitudes of the velocity characteristic during the performance of the causing step. The angular magnitudes can alternatively be selected to maintain a deceleration rate of the marine vessel below a preselected maximum value. The causing step of the present invention can be combined with a step of stopping the generation of the thrusts in response to a signal to exert a braking force on the marine vessel. In other words, as the two marine propulsion devices are rotated about their respective steering axes to exert a hydrodynamic braking force on the marine vessel, the propellers can simultaneously be caused to stop rotating or, alternatively, begin rotating in a reverse direction.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
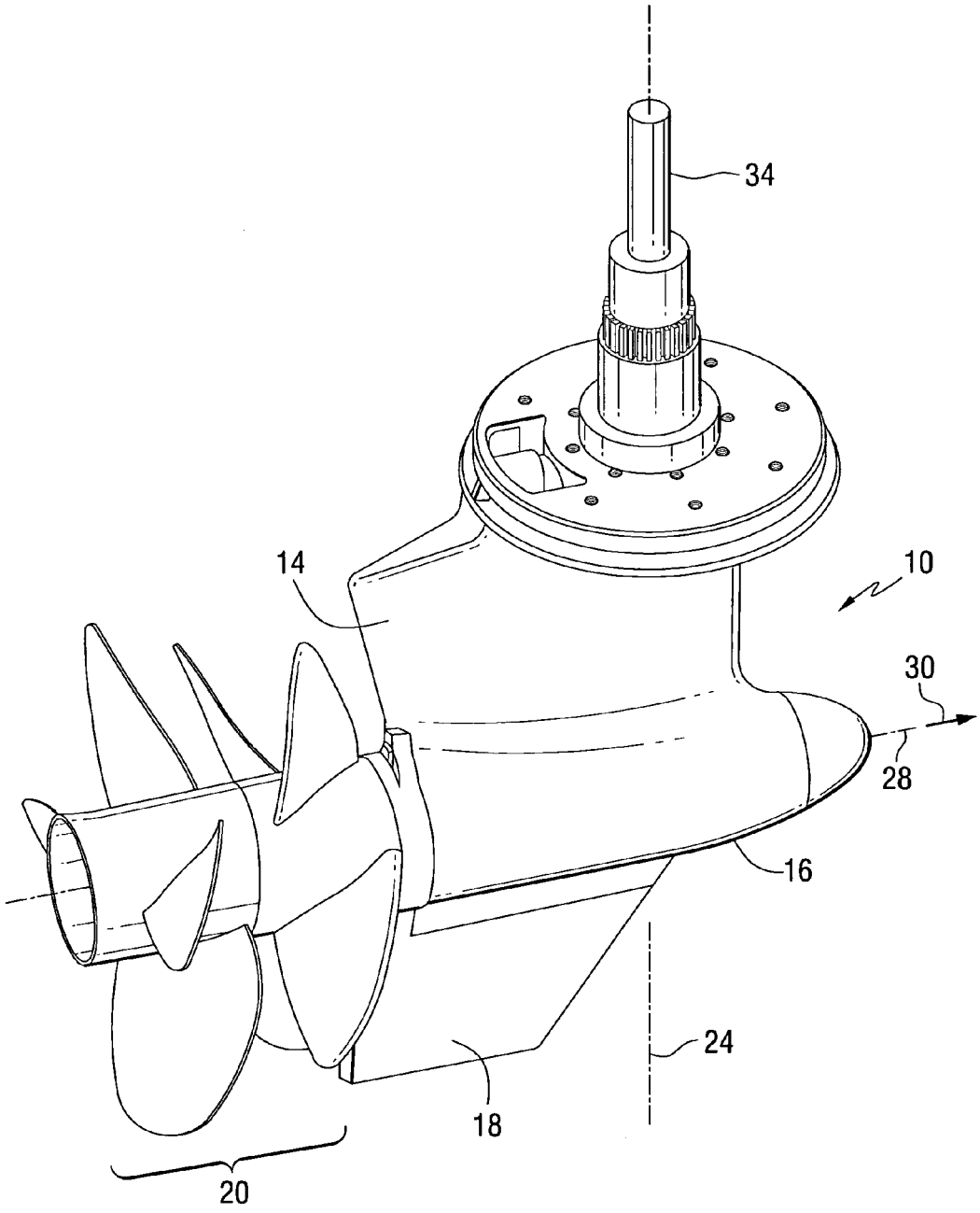
FIG. 1 is an isometric representation of the underwater portion of a marine propulsion device.

Throughout the description of the preferred embodiment of the present invention, like components will be identified by like reference numerals.

FIG. 1 is an isometric representation of a marine propulsion device 10. It is configured to extend downwardly through a hull and into the water below a marine vessel. The driveshaft housing 14, gear case 16, skeg 18, and the propellers 20 are supported below the wetted hull of a marine vessel. The marine propulsion device 10 is configured to be rotatable about a generally vertical steering axis 24. The propellers 20 are attached to a propeller shaft (not shown in FIG. 1) which is supported for rotation about a propeller shaft axis 28. The propellers 20 generate a thrust in a thrust direction 30 as represented by the arrow in FIG. 1.

Figure 2:
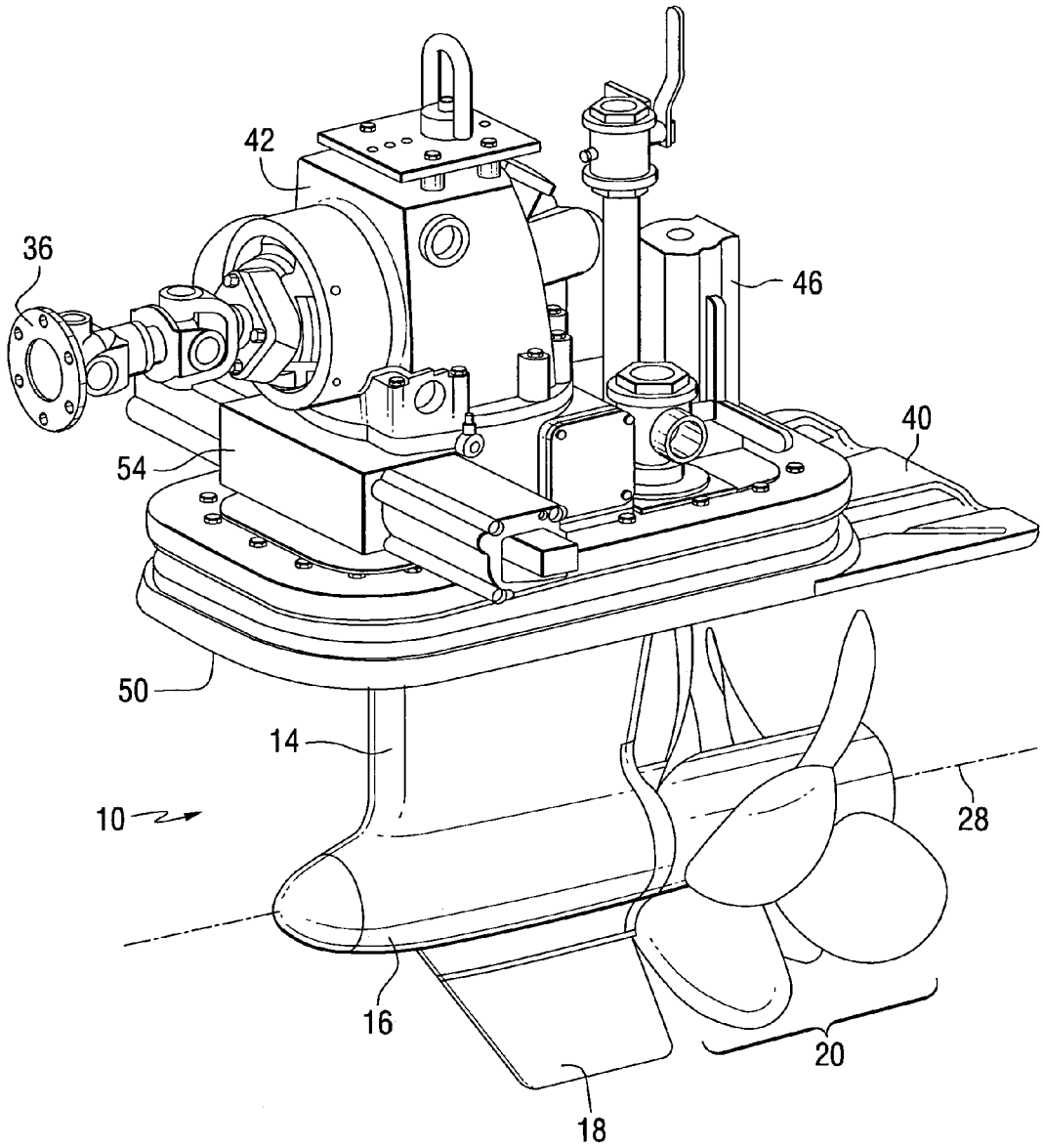
FIG. 2 shows the marine propulsion device in combination with the above-hull components necessary to control movement of the marine vessel.

FIG. 2 shows the marine propulsion device 10 in combination with other components that are used to provide torque for the driveshaft 34, shown in FIG. 1, and the necessary force to affectuate steering of the marine propulsion device 10. Shaft coupling 36 is connectable to an output shaft of an engine to provide torque which drives the propellers 20. Above a trim plate 40, a gear housing 42 transmits the torque from the engine to the driveshaft 34, which is illustrated in FIG. 1, and to a propeller shaft which rotates about axis 28. A hydraulic actuator 46 is used to control the trim of the marine propulsion device 10. It should be understood that the surface identified by reference numeral 50 is proximate the surface of the hull of a marine vessel when the system shown in FIG. 2 is assembled to a marine vessel. Hydraulic steering cylinders, along with a hydraulic valve assembly, are identified by reference numeral 54 in FIG. 2. These hydraulic steering cylinders cause the marine propulsion device 10 to rotate about its steering axis 24, which is illustrated in FIG. 1. The relative positions of the marine propulsion devices and the hull of a marine vessel are illustrated and described in detail in U.S. Pat. No. 5,755,605 which is discussed above. Similarly, U.S. Pat. Nos. 6,623,320 and 6,705,907 show the relative positions of a marine vessel and a marine propulsion device which is supported below the marine vessel.

A preferred embodiment of the present invention relates to a method for operating a marine vessel which is equipped with two marine propulsion devices such as the device illustrated in FIGS. 1 and 2. More specifically, a preferred embodiment of the present invention relates to a method for exerting a braking force on a marine vessel which does not depend solely on the rotational control of the propellers 20. When the propellers 20 are stopped from rotating or caused to rotate in a reverse direction, a preferred embodiment of the present invention contributes additional braking force on the marine vessel by rotating the drive units about their steering axes.

Figure 3:
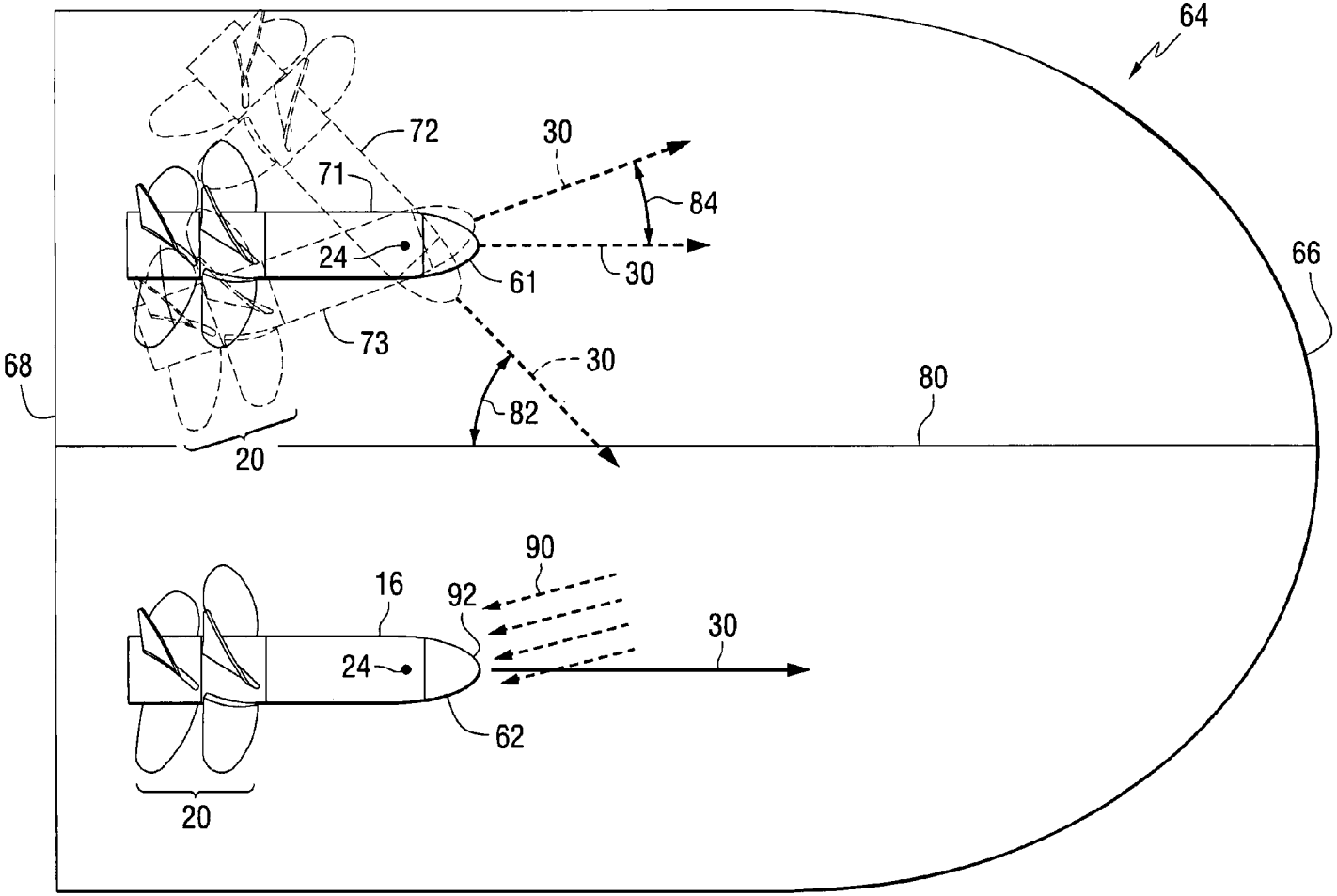
FIG. 3 is a simplified representation of a marine vessel with two marine propulsion devices shown in various positions.

FIG. 3 is a highly schematic simplified representation of two marine propulsion devices, 61 and 62, which are used to illustrate several characteristics of the system which is used in conjunction with a preferred embodiment of the present invention. For purposes of this description, a marine vessel 64 is illustrated with the two marine propulsion devices, 61 and 62, shown in their positions as would be viewed from under the hull of the marine vessel 64. The marine vessel 64 is shown with its bow 66 and stern 68. As such, the propellers 20 provide thrusts which push against the marine vessel 64. For purposes of comparison, some of the patents described above are of the "tractor-type" which use propellers to pull a marine propulsion device through the water and, as a result of the connection between the marine propulsion device and the marine vessel, the tractor-type drive exerts a pulling force on the marine vessel. This difference between a pushing thrust, as illustrated in FIG. 3, and the pulling force of a tractor-type drive does not affect the scope of the present invention which could be used in combination with either type of marine propulsion system.

With continued reference to FIG. 3, the illustration of the starboard marine propulsion device 61 is shown in three alternative positions. In the first position, identified by reference numeral 71 and shown in solid lines, the thrust direction 30 is straight ahead and generally parallel to a longitudinal centerline 80 which extends from the stern 68 to the bow 66. This longitudinal centerline 80 is used for geometric reference in the description of the characteristics of the marine propulsion device. The dashed line representation 72 shows the maximum clockwise rotation of the marine propulsion device about its steering axis 24. In one particular embodiment of the present invention, angle 82 is approximately forty-five degrees. The other representation 73 of the marine propulsion device shows its maximum rotation in a counterclockwise direction about the steering axis 24 which represents an angle 84 of approximately fifteen degrees. Therefore, in this particular embodiment of the marine propulsion system, the marine propulsion device has a total range of travel of approximately sixty degrees. In the representations illustrated in FIG. 3, it should be understood that the thrust direction 30 is assumed to be coaxial with the propeller shaft supported within the gear case of the marine propulsion system.

With continued reference to FIG. 3, the lower illustration 62 in FIG. 3 is provided to show the relative directions of the thrust direction 30 resulting from the operation of propellers 20 and the direction of water flow, represented by dashed line arrows 90 relative to leading portions 92 of the marine propulsion device 62. The leading portions 92 of the marine propulsion device typically are proximate the nose of the gear case 16. The direction of water flow 90 can possibly be different than a direction which is generally parallel to the longitudinal centerline 80 of the marine vessel 64. Certain applications of these types of marine propulsion systems direct the thrust direction 30 parallel to the direction of water flow 90 when the marine vessel 64 is traveling in a straight line. This is done for hydrodynamic efficiency and described in International Patent Application WO 03/093102. However, this "toe-in" of the marine drives, which results in their respective thrust directions 30 converging at a point forward of the steering axes 24, is not necessary in all applications of these types of drives and is not limiting to the concepts of the present invention.

Figure 4:
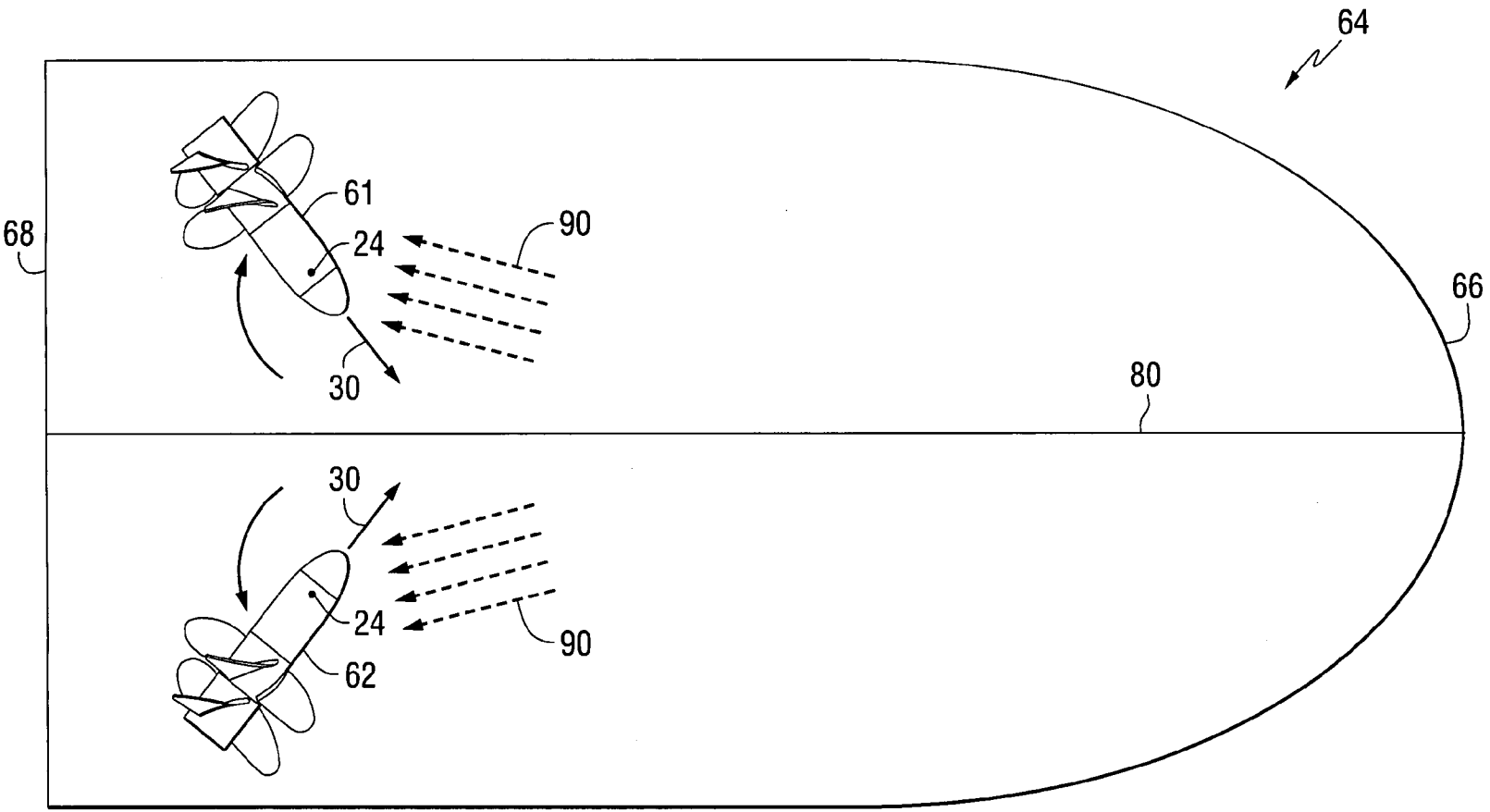
FIG. 4 shows a marine vessel with two marine propulsion devices positioned to exert a hydrodynamic resistance which results in a braking force on the marine vessel.

With reference to FIG. 4, the starboard and port marine propulsion devices, 61 and 62, are rotated in opposite directions in order to exert a braking force on the marine vessel 64. By rotating the marine propulsion devices in this way, the relative direction of water flow 90 causes the water, flowing past the marine propulsion devices, to strike the sides of the devices more directly rather than flow around the marine propulsion devices more hydrodynamically, as would occur if the direction of water flow 90 was aligned with the thrust directions 30. This rotation of the marine drives creates an increased hydrodynamic resistance to movement of the drives through the water. This hydrodynamic resistance to movement of the drives results in a braking force being exerted on the marine vessel 64. This braking force is greater than would result from the mere stopping of propeller rotation or even the reversal of propeller rotation, as is generally used in prior art systems.

The magnitude of the angular rotation of the marine propulsion drives about their respective steering axes affects the rate at which the marine vessel is slowed. Naturally, a relatively small angular magnitude will create less hydrodynamic resistance than if the marine drives are rotated to a greater angular magnitude.

A factor which must be considered during the braking procedure is the effect of a rapid deceleration on the passengers of the marine vessel. An extremely rapid deceleration could cause the passengers to lurch forward. In order to maintain passenger safety and avoid this potential situation, the present invention can be configured to control the rotational movement of the marine propulsion devices as a function of the resulting deceleration or deceleration rate of the marine vessel. Several embodiments of the present invention are provided in order to allow the system to be configured in such a way that it best suits the marine vessel with which it is used and the desired results. Some of these alternative embodiments will be discussed below.

Figure 5:
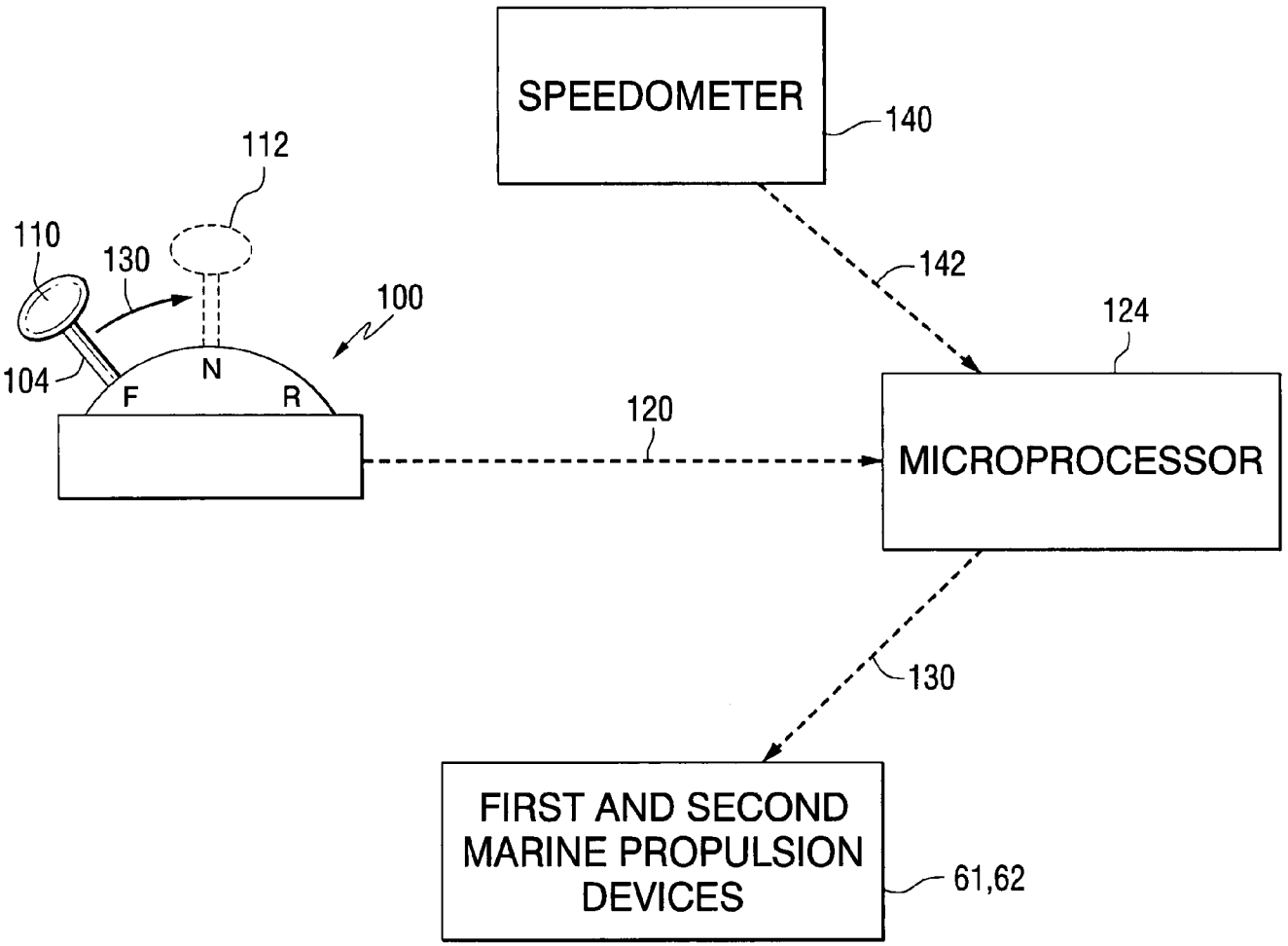
FIG. 5 is a simplified representation of a manually movable throttle control device connected in signal communication with a microprocessor.

FIG. 5 illustrates a manually operable throttle control mechanism 100 which is generally known to those skilled in the art. It has a handle 104 which is manually movable, between forward, neutral, and reverse positions. The amount of movement into the forward or reverse positions determines the resulting engine speed and, as a typical result, the speed of the marine vessel. During a stopping maneuver, the operator typically moves the handle 104 from the initial position identified by reference numeral 110 to the current position identified by reference numeral 112. It should be understood that the handle 104 may be moved further, into the reverse position, to cause the propellers to begin to rotate in an opposite direction. This is not always done. Movement of the handle 104 into the neutral position identified by reference numeral 112 will result in the propellers being disconnected from the engine driveshaft. In one embodiment of the present invention, a signal is provided from the manually operable throttle control mechanism 100, as represented by line 120, to a microprocessor 124. The microprocessor 124 can determine the rate at which the movement 130 of the handle 104 was done. If it is a relatively slow movement, the microprocessor 124 can interpret the stop command as being a non-emergency situation. If, on the other hand, the handle 104 is rapidly moved from the forward position to the neutral position, the microprocessor 124 can interpret this as requiring a more rapid braking of the marine vessel. Appropriate steering commands are provided, as represented by line 130, to both marine drives, 61 and 62.

With continued reference to FIG. 5, a speedometer 140 is shown providing a signal, on line 142, to the microprocessor 124. This allows the microprocessor 124 to have additional information relating to the marine vessel. It allows the microprocessor 124 to not only determine the velocity of the marine vessel but, in addition, it allows the microprocessor to calculate the deceleration or deceleration rate (i.e. "jerk") of the marine vessel in response to movement of the two marine propulsion drives, 61 and 62. The speedometer 140 can be any type of speedometer that allows the microprocessor 124 to determine or calculate information relating to the forward movement of the marine vessel. A conventional rotating element (e.g. paddle wheel) speedometer, a pitot tube device, or a global positioning satellite (GPS) device can be used to perform the function of the speedometer 140. In addition, it should be understood that any component or device that provides the necessary information relating to the movement of the marine vessel can be implemented for the purpose of performing a preferred embodiment of the present invention.

Figure 6:
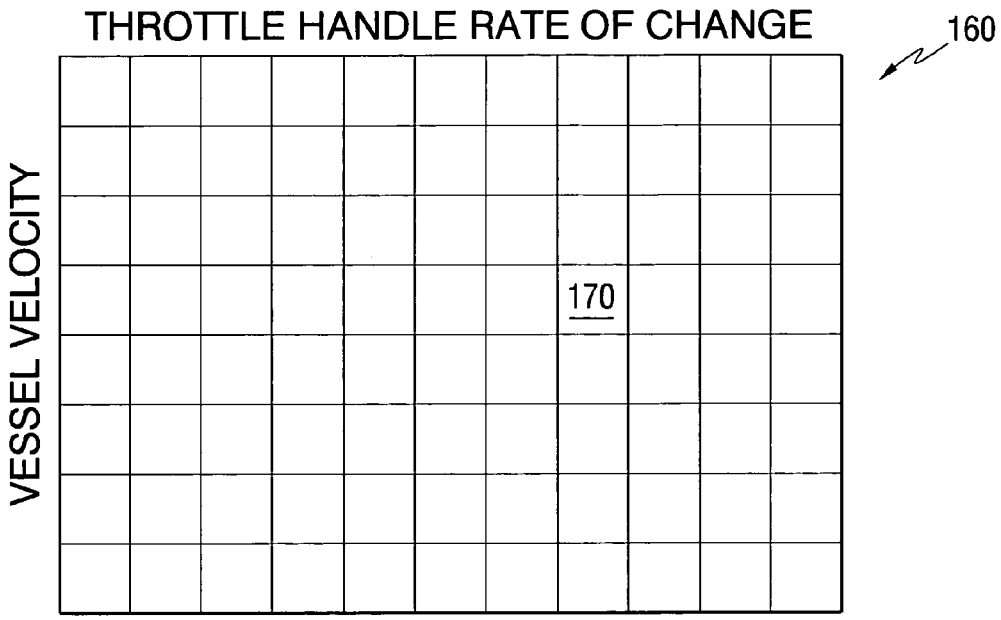
FIGS. 6–8 show various data storage tables that can be used in various embodiments of the present invention.

FIG. 6 is a simplified representation of a table that can be stored in the microprocessor 124 described in conjunction with FIG. 5. With reference to FIGS. 5 and 6, information can be stored in the Table 160 as a function of both the velocity of the marine vessel at any particular instant in time and the rate of change of position of the handle 104 of the manually controllable throttle mechanism 100. As an example, immediately prior to the movement of the handle 104 by the operator of the marine vessel, the vessel may be traveling at a velocity represented by the row in which the reference numeral 170 appears in FIG. 6. If the rate of manual movement of the throttle handle corresponds to the row in which reference numeral 170 appears, for example, the angular magnitude stored in the position 170 would be used. The microprocessor 124 would cause both marine propulsion devices to rotate about their respective axes by an amount represented by the angular magnitude stored at position 170. As a result, the urgency of the braking command, represented by the rate of movement of the handle 104, is combined with the instantaneous velocity of the marine vessel at the time the command is received. Therefore, if an urgent braking command is received when the marine vessel is traveling at a high rate of speed, the angular magnitude stored at that position of the table represents an angular magnitude that appropriately brakes the marine vessel without exceeding a deceleration effect or a deceleration rate that could otherwise be deleterious, as discussed above.

Figure 7:
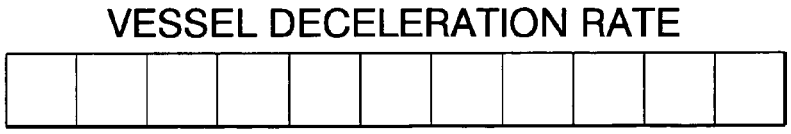

FIG. 7 represents an alternative method for determining the angular magnitude to be used for braking the marine vessel. It is based on the assumption that the operator always wishes that the marine vessel be stopped as quickly as possible without exceeding a preselected safe deceleration or deceleration rate. It should be understood that this embodiment of the present invention could control the angle of rotation of the marine propulsion devices as a function of the deceleration or the deceleration rate, or both. Therefore, when the handle 104 is moved to the neutral or reverse position, representing a braking command, the microprocessor 124 immediately begins to move the two marine propulsion devices into their hydrodynamic resistance positions, shown in FIG. 4, and immediately begins monitoring the deceleration or deceleration rate of the marine vessel with information obtained from the speedometer 140. If the maximum deceleration or deceleration rate has not been exceeded, the marine propulsion devices continue to move further toward their maximum positions. This results in further braking. As the microprocessor 124 receives subsequent information from the speedometer 140 indicating that the maximum deceleration or deceleration rate is being approached, the marine propulsion devices can be stopped in their current position or, in certain circumstances, be rotated back toward a less hydrodynamically resistive position in order to assure that the maximum deceleration or deceleration rate is not exceeded.

Figure 8:
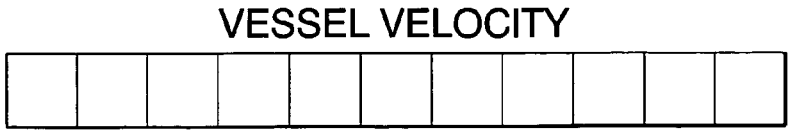

A simpler version of the present invention can be implemented with a storage table such as that illustrated in FIG. 8. A plurality of predetermined angular magnitudes is stored as a function of vessel velocity. When a braking command is received by the microprocessor 124 from the throttle device 100, the angular magnitude at which the marine propulsion devices are set is determined solely as a factor of the instantaneous velocity of the marine vessel when the braking command is received by the microprocessor.

It can be seen that many different varieties of control schemes can be used to determine the angular magnitudes used in various embodiments of the present invention. These range from simple determinations of angular magnitude, such as represented in FIG. 8, to more complex systems such as that represented in FIG. 6. As an example, an alternative method for determining the proper angular magnitude could comprise the step of basing that selection solely on the speed by which the handle 104 is moved from its initial position into a neutral position which indicates a braking command. This type of system could select the angular magnitude without consideration of the vessel velocity or the deceleration or the deceleration rate. Naturally, it should be understood that the determination of which system is best for selecting the angular magnitudes is a function of the type of marine vessel on which the present invention is implemented and the desired response of the marine propulsion system in circumstances when a braking command is provided.

With reference to FIGS. 1–8, it can be seen that a method for controlling the movement of a marine vessel, in accordance with a preferred embodiment of the present invention, comprises the steps of providing a first marine propulsion device 61 and a second marine propulsion device 62, determining a velocity characteristic of the marine vessel, receiving a signal from a throttle control device 100 which represents a command to cease forward movement of the marine vessel, stopping the generation of the first and second thrusts in response to the signal, determining a rate of movement of the throttle handle device 100 from its initial forward marine vessel velocity position to a current marine vessel velocity position, and causing the two marine propulsion devices, 61 and 62, to rotate in opposite rotational directions. The first and second marine propulsion devices are rotated by generally equal, but opposite, angular magnitudes. Although the directions of rotation of the first and second marine propulsion devices are in opposite directions, the absolute magnitudes of the angular magnitudes are generally equal to each other. Throughout the description of the preferred embodiment, it is recognized that the two angular magnitudes would have opposite algebraic signs, but are generally equal in an absolute magnitude sense. The angular magnitudes can possibly be generally equal to the maximum possible rotational travel of the first and second marine propulsion devices. In the example described above, in conjunction with FIG. 3, that absolute maximum, which is identified by reference numeral 82, is approximately forty-five degrees. However, it should be recognized that sufficient hydrodynamic resistance can possibly be achieved with significantly less angular rotation than the maximum that is physically possible. In certain embodiments of the present invention, the first and second marine propulsion devices might have to be rotated up to approximately forty five degrees, in opposite directions, to achieve the necessary hydrodynamic resistance. This can occur when the marine vessel is traveling at relatively slow speeds. In other embodiments, the rotation may only have to be approximately ten to thirty degrees. It should also be recognized that some amount of hydrodynamic resistance can be achieved if the two marine propulsion devices are only rotated approximately three to ten degrees.

As described above, several alternative techniques are available for use in determination of the actual value of the angular magnitudes by which the marine propulsion devices are rotated. These alternative techniques are described above in conjunction with FIGS. 6–8. In addition, as also described above, the marine propulsion devices can be rotated as far as possible while monitoring the deceleration or deceleration rate of the marine vessel. As the marine vessel decelerates by a magnitude which approaches a preselected maximum deceleration or deceleration rate, the rotation of the marine propulsion devices about their respective steering axes can be stopped or, in certain applications, reversed to assure that the maximum deceleration or deceleration rate is not exceeded.

Although the present invention has been described in considerable detail and illustrated to show several embodiments, it should be understood that alternative embodiments are also within its scope.

I claim:

1. A method for controlling the movement of a marine vessel, comprising the steps of:

providing a first marine propulsion device which is attached to said marine vessel at a first side of a longitudinal centerline of said marine vessel and which extends downwardly into water in which said marine vessel is operated, said first marine propulsion device being configured to support a first propulsor which is configured to generate a first thrust parallel to a first thrust direction, said first marine propulsion device being supported by said marine vessel for rotation about a first generally vertical steering axis, said first marine propulsion device being rotatable about said first generally vertical steering axis relative to a first reference position in which said first thrust direction is generally parallel to said longitudinal centerline;

providing a second marine propulsion device which is attached to said marine vessel at a second side of said longitudinal centerline of said marine vessel and which extends downwardly into water in which said marine vessel is operated, said second marine propulsion device being configured to support a second propulsor which is configured to generate a second thrust parallel to a second thrust direction, said second marine propulsion device being supported by said marine vessel for rotation about a second generally vertical steering axis, said second marine propulsion device being rotatable about said second generally vertical steering axis relative to a second reference position in which said second thrust direction is generally parallel to said longitudinal centerline;

receiving a command to apply a braking force on said marine vessel; and causing each of said first and second marine propulsion devices to rotate in opposite rotational directions about said first and second steering axes, respectively, by selected angular magnitudes in response to said command;

determining a velocity characteristic of said marine vessel; and selecting said angular magnitudes as a function of said velocity characteristic.

2. The method of claim 1, wherein:

said first and second marine propulsion devices are rotatable about said first and second generally vertical steering axes, respectively in both clockwise and a counterclockwise directions.

3. The method of claim 1, wherein:

said angular magnitudes are selected to create an increased hydrodynamic resistance to movement of said first and second marine propulsion devices through water.

4. The method of claim 3, wherein:

said hydrodynamic resistance to movement of said first and second marine propulsion devices through said water results in a braking force being exerted on said marine vessel.

5. The method of claim 1, wherein:

said first side is the port side of said longitudinal centerline of said marine vessel and said second side is the starboard side of said longitudinal centerline of said marine vessel.

6. The method of claim 5, wherein:

said causing step comprises the step of rotating said first marine propulsion device in a clockwise direction, when viewed from said marine vessel along said first steering axis, and the step of rotating said second marine propulsion device in a counterclockwise direction, when viewed from said marine vessel along said second steering axis.

7. The method of claim 1, wherein:

said angular magnitudes are generally equal to each other.

8. The method of claim 1, wherein:

said angular magnitudes are greater than twenty degrees.

9. The method of claim 1, wherein:

said angular magnitudes are selected from a table of potential angular magnitudes which are stored as a function of a plurality of velocity magnitudes.

10. The method of claim 1, further comprising:

determining a rate of movement of a throttle control device from an initial forward marine vessel velocity position to a current marine vessel velocity position.

11. The method of claim 10, wherein:

said causing step is performed when said current marine vessel velocity position is a position which indicates a zero velocity of said marine vessel.

12. The method of claim 1, wherein:

said selecting step comprises a plurality of selections of said angular magnitudes which are sequentially selected as a function of changing magnitudes of said velocity characteristic during the performance of said causing step.

13. The method of claim 1, wherein:

said velocity characteristic is a deceleration of said marine vessel.

14. The method of claim 1, wherein:

said angular magnitudes are selected to maintain a deceleration rate below a preselected maximum value.

15. The method of claim 1, further comprising:

receiving a signal from a throttle control device which represents a command to cease forward movement of said marine vessel; and stopping the generation of said first and second thrusts in response to said signal.

16. The method of claim 15, wherein:

said causing step is performed generally simultaneously with said stopping step.

17. A method for controlling the movement of a marine vessel, comprising the steps of:

providing a first marine propulsion device which is attached to said marine vessel at a port side of a longitudinal centerline of said marine vessel and which extends downwardly into water in which said marine vessel is operated, said first marine propulsion device being configured to support a first propulsor which is configured to generate a first thrust parallel to a first thrust direction, said first marine propulsion device being supported by said marine vessel for rotation about a first generally vertical steering axis, said first marine propulsion device being rotatable about said first generally vertical steering axis;

providing a second marine propulsion device which is attached to said marine vessel at a starboard side of said longitudinal centerline of said marine vessel and which extends downwardly into water in which said marine vessel is operated, said second marine propulsion device being configured to support a second propulsor which is configured to generate a second thrust parallel to a second thrust direction, said second marine propulsion device being supported by said marine vessel for rotation about a second generally vertical steering axis, said second marine propulsion device being rotatable about said second generally vertical steering axis;

determining a velocity characteristic of said marine vessel;

receiving a signal from a throttle control device which represents a command to control forward movement of said marine vessel;

determining a rate of movement of said throttle control device from an initial forward marine vessel velocity position to a current marine vessel velocity position; and causing each of said first and second marine propulsion devices to rotate in opposite rotational directions about said first and second steering axes, respectively, by angular magnitudes greater than three degrees from positions where said first and second thrust directions of said first and second marine propulsion devices, respectively, are generally aligned with a direction of water flow relative to leading portions of said first and second marine propulsion devices, respectively, said angular magnitudes being selected to create an increased hydrodynamic resistance to movement of said first and second marine propulsion devices through water which results in a braking force being exerted on said marine vessel, said causing step being performed when said current marine vessel velocity position is a position which represents a command for a zero velocity of said marine vessel.

18. The method of claim 17, further comprising:

stopping the generation of said first and second thrusts in response to said signal.

19. The method of claim 18, wherein:

said velocity characteristic is a deceleration of said marine vessel, said angular magnitudes being selected as a function of said deceleration.

20. The method of claim 18, wherein:

said angular magnitudes are selected from a table of potential angular magnitudes which are stored as a function of a plurality of marine vessel velocity magnitudes.

21. The method of claim 20, wherein:

a plurality of said angular magnitudes are sequentially selected as a function of changing magnitudes of said velocity characteristic during the performance of said causing step.

22. The method of claim 19, wherein:

said causing step is performed generally simultaneously with said stopping step.

23. The method of claim 18, wherein:

said velocity characteristic is a deceleration rate of said marine vessel, said angular magnitudes being selected as a function of said deceleration rate.

24. The method of claim 18, wherein:

said causing step comprises the step of rotating said first marine propulsion device in a clockwise direction, when viewed from said marine vessel along said first steering axis, and the step of rotating said second marine propulsion device in a counterclockwise direction, when viewed from said marine vessel along said second steering axis.

25. The method of claim 24, wherein:

said angular magnitudes are generally equal to each other.

26. A method for controlling the movement of a marine vessel, comprising the steps of:

providing a first marine propulsion device which is attached to said marine vessel at a port side of a longitudinal centerline of said marine vessel and which extends downwardly into water in which said marine vessel is operated, said first marine propulsion device being configured to support a first propulsor which is configured to generate a first thrust parallel to a first thrust direction, said first marine propulsion device being supported by said marine vessel for rotation about a first generally vertical steering axis, said first marine propulsion device being rotatable about said first generally vertical steering axis;

providing a second marine propulsion device which is attached to said marine vessel at a starboard side of said longitudinal centerline of said marine vessel and which extends downwardly into water in which said marine vessel is operated, said second marine propulsion device being configured to support a second propulsor which is configured to generate a second thrust parallel to a second thrust direction, said second marine propulsion device being supported by said marine vessel for rotation about a second generally vertical steering axis, said second marine propulsion device being rotatable about said second generally vertical steering axis;

determining a velocity characteristic of said marine vessel;

receiving a signal from a throttle control device which represents a command to cease forward movement of said marine vessel;

stopping the generation of said first and second thrusts in response to said signal;

determining a rate of movement of said throttle control device from an initial forward marine vessel velocity position to a current marine vessel velocity position; and causing said first marine propulsion device to rotate in a clockwise direction, when viewed from said marine vessel along said first steering axis, and said second marine propulsion device to rotate in a counterclockwise direction, when viewed from said marine vessel along said second steering axis, by angular magnitudes greater than ten degrees from positions where said first and second thrust directions of said first and second marine propulsion devices, respectively, are generally aligned with a direction of water flow relative to leading portions of said first and second marine propulsion devices, respectively, said angular magnitudes being selected to create an increased hydrodynamic resistance to movement of said first and second marine propulsion devices through water which results in a braking force being exerted on said marine vessel, said causing step being performed when said current marine vessel velocity command is a command for a zero velocity of said marine vessel, said angular magnitudes being generally equal to each other, said causing step being performed generally simultaneously with said stopping step, said angular magnitudes are selected from a plurality of potential angular magnitudes which are stored as a function of a plurality of velocity characteristic magnitudes.

27. The method of claim 26, wherein:

said velocity characteristic is a deceleration of said marine vessel, said angular magnitudes being selected as a function of said deceleration.

28. The method of claim 26, wherein:

a plurality of said angular magnitudes are sequentially selected as a function of changing magnitudes of said velocity characteristic during the performance of said causing step.

29. The method of claim 26, wherein:

said angular magnitudes are selected to maintain a deceleration rate below a preselected maximum value.

30. The method of claim 26, wherein:

said angular magnitudes are selected as a function of said rate of movement of said throttle control device.

* * * * *